US009239137B2

(12) United States Patent
Bromer

(10) Patent No.: US 9,239,137 B2
(45) Date of Patent: Jan. 19, 2016

(54) LIGHTING DEVICE AND METHODS OF MAKING THE SAME

(71) Applicant: EMPIRE TECHNOLOGY DEVELOPMENT LLC, Wilmington, DE (US)

(72) Inventor: Nicholas Sheppard Bromer, Marietta, PA (US)

(73) Assignee: Empire Technology Development LLC, Wilmington, DE (US)

( * ) Notice: Subject to any disclaimer, the term of this patent is extended or adjusted under 35 U.S.C. 154(b) by 0 days.

(21) Appl. No.: 13/876,473

(22) PCT Filed: Sep. 28, 2012

(86) PCT No.: PCT/US2012/057948
§ 371 (c)(1),
(2) Date: Mar. 27, 2013

(87) PCT Pub. No.: WO2014/051620
PCT Pub. Date: Apr. 3, 2014

(65) Prior Publication Data

US 2015/0211689 A1 Jul. 30, 2015

(51) Int. Cl.

| | |
|---|---|
| ***F21K 99/00*** | (2010.01) |
| ***F21V 21/00*** | (2006.01) |
| ***F21V 7/00*** | (2006.01) |

(Continued)

(52) U.S. Cl.
CPC ..... *F21K 9/50* (2013.01); *F21V 7/0066* (2013.01); *F21V 11/00* (2013.01); *F21V 21/00* (2013.01); *F21V 23/06* (2013.01); *F21V 29/70* (2015.01); *F21V 31/04* (2013.01); *F21V 33/0012* (2013.01); *F21W 2121/00* (2013.01); *F21Y 2101/02* (2013.01); *F21Y 2113/005* (2013.01)

(58) Field of Classification Search
CPC ..... F21V 11/00; F21V 31/04
See application file for complete search history.

(56) References Cited

U.S. PATENT DOCUMENTS

| | | | |
|---|---|---|---|
| 5,779,924 | A | 7/1998 | Krames et al. |
| 6,229,160 | B1 | 5/2001 | Krames et al. |

(Continued)

FOREIGN PATENT DOCUMENTS

| | | | |
|---|---|---|---|
| CN | 101718400 | A | 6/2010 |
| EP | 2189708 | | 5/2010 |

(Continued)

OTHER PUBLICATIONS

Quantum Devices, Inc., "LED Theory and Application Notes", 1998, 4pgs. http://www.quantumdev.com/pdf/qf2-01.pdf.

(Continued)

*Primary Examiner* — Elmito Breval
(74) *Attorney, Agent, or Firm* — Knobbe Martens Olson & Bear LLP

(57) ABSTRACT

Lighting devices are disclosed having a light-transmissive resin sheet and one or more light sources disposed within the light-emitting resin sheet. The light sources may, in some embodiments, be oriented so that a large portion of light emitted from the light sources exhibits total internal reflection within the light-transmissive resin sheet and is trapped inside the sheet. This total internal reflection may, for example, advantageously provide a more uniform light emitted from the lighting device when scattered from objects inside the sheet. Methods of making and using the lighting device are also disclosed.

25 Claims, 8 Drawing Sheets

(51) Int. Cl.

| | |
|---|---|
| ***F21V 23/06*** | (2006.01) |
| ***F21V 11/00*** | (2015.01) |
| ***F21V 31/04*** | (2006.01) |
| ***F21V 33/00*** | (2006.01) |
| ***F21V 29/70*** | (2015.01) |
| *F21W 121/00* | (2006.01) |
| *F21Y 101/02* | (2006.01) |
| *F21Y 113/00* | (2006.01) |

(56) References Cited

U.S. PATENT DOCUMENTS

| | | | |
|---|---|---|---|
| 6,323,063 | B2 | 11/2001 | Krames et al. |
| 6,330,111 | B1 | 12/2001 | Myers |
| 7,537,374 | B2 | 5/2009 | Schardt et al. |
| 7,705,826 | B2 | 4/2010 | Kalt et al. |
| 7,781,794 | B2 | 8/2010 | Suehiro et al. |
| 7,789,546 | B2 | 9/2010 | Liu et al. |
| 7,815,355 | B2 | 10/2010 | Thompson et al. |
| 2010/0084665 | A1 | 4/2010 | Daniels et al. |
| 2011/0141726 | A1 | 6/2011 | Xue et al. |
| 2011/0182053 | A1 | 7/2011 | Khan |

FOREIGN PATENT DOCUMENTS

| | | |
|---|---|---|
| JP | 5064278 | 10/2012 |
| TW | 1329373 | 8/2010 |
| WO | WO 2006/060905 | 6/2006 |

OTHER PUBLICATIONS

Haitz, et al. "Light-Emitting Diodes" Chapter 12, Hewlett-Packard Co., San Jose, CA; 39pgs. [printed from internet, Dec. 17, 2011] http://photonics.intec.ugent.be/education/IVPV/res_handbook/v1ch12.pdf.

Keeping, Steven, "Improving the Efficiency of LED Light Emission", TechZone Lighting Solutions, 4pgs. [retrieved on May 22, 2012], from internet http://www.digikey.com/us/en/techzone/lighting/resources/articles/Improving-the-Efficiency-of-LED-Light-Emission.html.

Article: [retrieved from internet] http://lib.semi.ac.cn:8080/tsh/dzzy/wsqk/SPIE/vol4776/4776-223.pdf; May 22, 2012.

Polyester (PET) Plastics, Jan. 7, 2009, [retrieved on Nov. 31, 2012], from internet: URL:http://www.gopolymers.com/plasti-types/polyester-pet-plastic.html paragraph 1.

International Search Report; International Application No. PCT/US2012/057948; Filing date Sep. 28, 2012, dated Dec. 17, 2012.

LIGHTING DEVICE AND METHODS OF MAKING THE SAME

CROSS-REFERENCE TO RELATED APPLICATIONS

This application is the U.S. National Phase under 35 U.S.C. §371 of International Application No. PCT/US2012/057948, filed Sep. 28, 2012, the contents of which are herein incorporated by reference in its entirety.

BACKGROUND

Light emitting diodes (or LEDS) have been used in various lighting systems, such as lamps, flash lights, and display devices. Light emitting diodes are often selected for various lighting applications because they provide improved energy efficiency relative to other light sources, such as incandescent lights. In general, light emitting diodes emit a narrow beam of light that can lead to poor light distribution.

SUMMARY

Some embodiments disclosed herein include a lighting device. In some embodiments, the lighting device includes a light-transmitting resin sheet extending locally in a first plane; and one or more light sources disposed within the light-transmissive resin sheet, each of the light sources comprising one or more light-emitting faces each extending in different planes. In some embodiments, each of the different planes of the light-emitting faces form an angle with the first plane of the light-transmitting resin sheet of about 35° to about 75°.

Some embodiments disclosed herein include a light-transmissive resin sheet having a first surface and a second surface on opposite sides; and one or more polyhedral light sources disposed in the light-transmissive resin sheet between the first surface and the second surface. In some embodiments, in each of the polyhedral light sources: a first vertex is closest to the first surface of the light-transmissive resin sheet relative to other vertices on the same polyhedral light source; a second vertex is closest to the second surface of the light-transmissive resin sheet relative to other vertices on the same polyhedral light source; and a distance between the first vertex and the second vertex is about the same as a length of a largest dimension of the polyhedral light sources.

Some embodiments disclosed herein include a lighting device including a light-transmitting resin sheet extending locally in a first plane and one or more light sources disposed within the light-transmitting resin. In some embodiments, each of the light sources comprising two or more light-emitting faces extending in different planes that meet at a vertex. In some embodiments, each of the different planes of the light-emitting faces form about the same angle with the first plane of the light-transmitting resin sheet.

Some embodiments disclosed herein include a method for making a lighting device, the method including: providing a first light-transmitting resin sheet comprising one or more cavities on one side of the first light-transmitting resin sheet, wherein the first light-transmitting resin sheet extends in a first plane; disposing one or more light sources at least partially within each of the cavities of the first light-transmitting resin sheet, wherein the light sources each comprise one or more light-emitting faces extending in different planes, and wherein each of the different planes of the light-emitting faces form an angle with the first plane of the first light-transmitting resin sheet of about 35° to about 75°; and fixing the light sources in optical contact with the first light-transmitting resin sheet.

Some embodiments disclosed herein include a lighting device prepared according to any of method for preparing the lighting device disclosed in the present application.

Some embodiments disclosed herein include a method of producing light, the method including applying a voltage to one or more light sources effective for the light sources to emit light from one or more light-emitting faces on each of the light sources. In some embodiments, the light sources are disposed within a light-transmitting resin sheet extending in a first plane, and the light-emitting faces on each of the light sources extend in different planes that form an angle with the first plane of the light-transmitting resin sheet of about 35° to about 75°.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through use of the accompanying drawings.

DETAILED DESCRIPTION

Figure 1A:
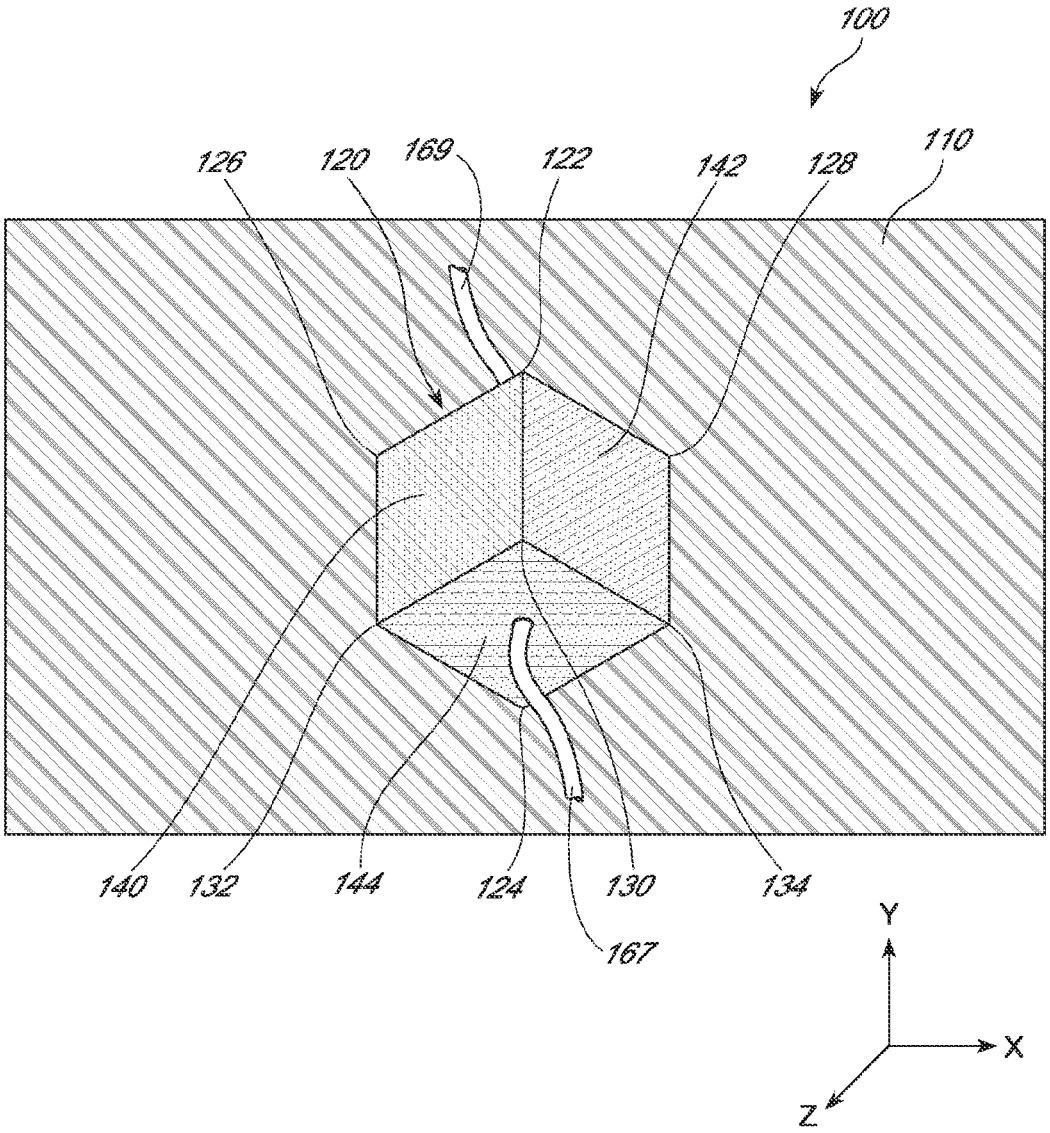
FIG. 1A is a partly perspective and partly cross-sectional view of one example of a lighting device within the scope of the present application.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be used, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and make part of this disclosure.

Some embodiments disclosed herein include a lighting device having a light-transmissive resin sheet and one or more light sources disposed within the light-emitting resin sheet. The light sources may, in some embodiments, be configured so that a large portion of light emitted from the light sources exhibits total internal reflection within the light-transmissive resin sheet. This total internal reflection may, for example, advantageously provide a more uniform light emitted from the lighting device. Methods of making and using the lighting device are also disclosed.

FIG. 1A is a perspective view of one example of a lighting device within the scope of the present application. Lighting device 100 includes light-transmissive resin sheet 110 having light source 120 disposed within light-transmissive resin sheet 110. Light source 120 is shown in perspective view and light-transmissive resin sheet 110 is shown in cross-sectional view, as if a portion of the light-transmissive resin sheet 110, which typically surrounds the light source 120, had been removed for the sake of illustration. Light source 120 can be, for example, an LED (light-emitting diode). Light source 120 is generally cubic-shaped with six planar faces. Face 140, face 142, and the three additional faces not visible in FIG. 1A may each be configured to emit light. Face 144 can be electrically coupled to first electrode 167. Second electrode 169 may be electrically coupled to a face on opposite sides of light source 120 relative to face 144 (e.g., a face that includes vertex 122, vertex 126, vertex 128 and a fourth vertex (not visible in FIG. 1A)). By applying a voltage between the first and second electrodes, light source 120 may emit light from the light-emitting faces, such as face 140, face 142, and the three additional faces not visible in FIG. 1A.

Light-transmissive resin sheet 110 is generally planar extending in the xz-plane. Light source 120 has a "cocked" orientation relative to light-transmissive resin sheet 110, where an internal diagonal extending between vertex 122 and vertex 124 is generally parallel to the y-axis. Thus, the internal diagonal of light source 120 is normal to the plane of light-transmissive resin sheet 110 (e.g., normal to the xz-plane as depicted in FIG. 1A). The center of light source 120 can be disposed at or near the midpoint along the thickness of light-transmissive resin sheet 110 (e.g., at the midpoint of light-transmissive resin sheet 110 along the y-axis as shown in FIG. 1A).

Figure 1B:
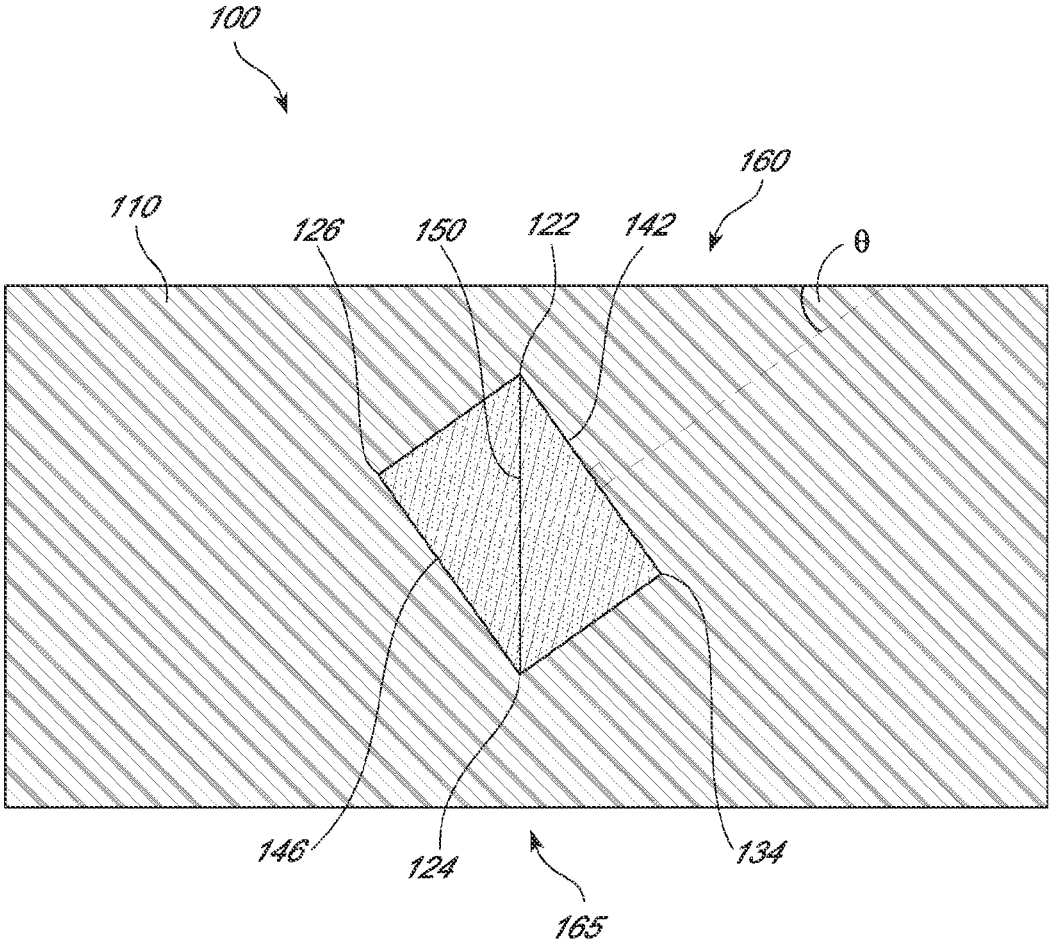
FIG. 1B is a cross-sectional view of a plane that includes vertex 122, vertex 124, vertex 134, and vertex 126 of light source 120 in lighting device 100.

FIG. 1B is a cross-sectional view of a plane that includes vertex 122, vertex 124, and vertex 126 of light source 120 in lighting device 100. In FIG. 1B both the light-transmissive resin sheet 110 and the light source 120 are shown in cross section, on a single cross-sectional plane, which is the plane of the paper. Face 146, visible in FIG. 1B, is on the opposite side of light source 120 relative to face 142 and is not visible in FIG. 1A. Internal diagonal 150 extends between vertex 122 and vertex 124, lies in the plane of the paper, and is generally perpendicular to the plane of light-transmissive resin sheet 110. The line indicating the face 142 appears longer than the lines perpendicular to it, because the line indicating the face 142 is a diagonal while the other line represents an edge, which in FIG. 1B will be in ratio equal to root 2 assuming a cube shape (the cube being rotated by one-eighth of a turn about the axis 150 from the position shown in FIG. 1A). Line 155 is perpendicular to face 142 and forms and an angle $\theta$ with the plane of light-emitting resin sheet. Similarly, face 142 extends in a plane that forms an angle $\psi=90-\theta$. Vertex 122 is disposed closest to first surface 160 of light-transmissive resin sheet 110 relative to the other seven vertices of light source 120, including, for example, vertex 124, vertex 126, vertex 128, vertex 130, vertex 132 and vertex 134 shown in FIG. 1A. Vertex 124 is disposed closest to second surface 165 of light-transmissive resin sheet 110 relative to the other seven vertices of light source 120, including, for example, vertex 122, vertex 126, vertex 128, vertex 130, vertex 132 and vertex 134 shown in FIG. 1A.

The light-transmissive resin sheet (e.g., light-transmissive resin sheet 110 depicted in FIG. 1A) is not particularly limited so long as the light-transmissive resin sheet can transmit light emitted from the light sources. The light-transmissive resin sheet may have a light transmittance for light emitted by the light sources of, for example, at least about 50%; at least about 60%; at least about 70%; at least about 80%; at least about 90%; or at least about 95%. In some embodiments, the light-transmissive resin sheet is substantially transparent for light emitted from the light sources.

The light-transmissive resin sheet may, in some embodiments, be flexible. For example, the light-transmissive resin sheet may be flexible so that the lighting device can be spirally wound into a roll without damaging the light-transmissive resin sheet (e.g., without causing cracking or crazing). As another example, the light-transmissive resin sheet may have sufficient flexibility so that the light device may have curvature with a radius of about 10 cm or about 50 cm without damaging the light-transmissive resin sheet. In some embodiments, the light-transmissive resin sheet is rigid.

The light-transmissive resin sheet can include one or more resins. The light-transmissive resin sheet can include, for example, at least about 30% by weight of one or more resins; at least about 50% by weight of one or more resins; at least about 70% by weight of one or more resins; at least about 90% by weight of one or more resins; or at least about 95% by weight of one or more resins. The one or more resins may be a thermoplastic, a thermoset, or a mixture thereof. Non-limiting examples of resins that may be contained in the light-transmissive resin sheet include polycarbonates, acrylics, epoxies, polyolefins, polyesters, and copolymers thereof. In some embodiments, the one or more resins in the light-transmissive resin sheet are amorphous.

The dimensions of the light-transmissive resin sheet can be modified depending on various factors, such as the number and size of light sources in the lighting device. The light-transmissive resin sheet may have a thickness of, for example, at least about 0.1 mm; at least about 0.5 mm; at least about 1 mm; at least about 2 mm; at least about 5 mm; or at least about 1 cm. The light-transmissive resin sheet may have a thickness of, for example, less than or equal to about 5 cm; less than or equal to about 1 cm; less than or equal to about 5 mm; or less than or equal to about 3 mm. In some embodiments, the light-transmissive resin sheet has a thickness of about 0.1 mm to about 10 cm. The light-transmissive resin sheet may have a surface area (e.g., an area of first surface 160 of light-transmissive resin sheet 110 depicted in FIG. 1B) of, for example, at least about 5 $mm^2$; at least about 50 $mm^2$; at least about 1 $cm^2$; at least about 5 $cm^2$; at least about 10 $cm^2$; or at least about 25 $cm^2$. Areas of many square meters are possible with the invention.

The lighting device may also include scattering elements disposed within the light-transmissive resin sheet. The scattering elements can generally be any change in materials or phase that exhibits a different indices of refraction relative the light-transmissive resin sheet, or reflective materials. The scattering elements can be, for example, titanium dioxide or silica particles or voids disposed in the light-transmissive resin sheet. In some embodiments, the scattering elements have a largest dimension of less than or equal to about 1 mm, or less than or equal to about 500 μm.

The lighting device can include one or more light sources (e.g., light source 120 as depicted in FIG. 1A) disposed in the light-transmissive resin sheet. The light sources may be any known light source in the art. In some embodiments, light sources are light emitting diodes. The light source may include one or more light-emitting faces (e.g., one, two, three, four, five, six, seven, eight, nine, ten, or more light-emitting faces). The light source may, in some embodiments, have a polyhedral shape, such as a tetrahedron, a rhombohedron, a rectangle pyramid, a cube, a cuboid, a parallelepiped, a decahedron, a dodecahedron, and the like. In some embodiments, the light source is cuboidal. In some embodiments, the light source is cubic-shaped. In some embodiments, the light source is a cubic-shaped light emitting diode.

The light sources can have various orientations relative to the light-transmissive resin sheet. For example, the light sources may in the "cocked" orientation (e.g., the orientation of light source 120 as depicted in FIGS. 1A and 1B). The light sources may be oriented so that the light-emitting faces of each light source form an angle with a plane in which the light-transmissive resin sheet extends locally. For example, light-transmissive resin sheet 110 depicted in FIG. 1A extends in the xy-plane and face 142 of light source 120 extends in a plane that forms an angle ψ with the xy-plane. As another example, the light-transmissive resin sheet may have a curved shape. The light-emitting faces of a light source disposed within the light-transmissive resin sheet can each extend in a plane that forms an angle with a plane that forms a tangent with the curved surface of the light-transmissive resin sheet at or near the location of the light source (if the light-transmissive resin sheet is curved rather than itself being planar). Thus, as used herein, the light-transmissive resin sheet "extending locally" in a plane refers to a plane that is tangent or parallel to the surface of the light-transmissive resin sheet at or near each light source.

The light sources may be oriented so that the light-emitting faces of each light source form an angle with a plane in which the light-transmissive resin sheet extends locally of, for example, at least about 35°; at least about 40°; at least about 45°; or at least about 50°. The light sources may be oriented so that the light-emitting faces of each light source form an angle with a plane in which the light-transmissive resin sheet extends locally of, for example, less than or equal to about 75°; less than or equal to about 70°; less than or equal to about 65°; or less than or equal to about 60°. In some embodiments, the light sources may be oriented so that the light-emitting faces of each light source form an angle with a plane in which the light-transmissive resin sheet extends locally of about 35° to about 75°. In some embodiments, the light sources may be oriented so that the light-emitting faces of each light source form about the same angle with a plane in which the light-transmissive resin sheet extends locally. For example, the light sources may be oriented so that the light-emitting faces of each light source form an angle of about 54.75° with a plane in which the light-transmissive resin sheet extends locally.

Without being bound to any particular theory, it is believed that orienting light-emitting faces of the light sources to form an angle of about 35° to about 75° with a plane in which the light-transmissive resin sheet extends locally can result in a large portion of emitted light to exhibit total internal reflection within the light-transmissive resin sheet. Scattering elements throughout the resin sheet can cause the light to be directed towards a surface of the light-transmissive resin sheet at an angle that is emitted from the lighting device rather than internally refracted. By internally refracting light when it is first emitted from the light sources, the lighting device may advantageously exhibit improved distribution of light.

The light-emitting faces in the light sources can be oriented so that lines extending perpendicular to the light-emitting faces (e.g., line 155 perpendicular to face 142 of light source 120 as depicted in FIG. 1B) form an angle with a plane in which the light-transmissive resin sheet extends locally of, for example, at least about 15°; at least about 20°; at least about 25°; or at least about 30°. The light-emitting faces in the light sources can be oriented so that lines extending perpendicular to the light-emitting faces form an angle with a plane in which the light-transmissive resin sheet extends locally of, for example, less than or equal to about 55°; less than or equal to about 50°; less than or equal to about 45°; or less than or equal to about 40°. In some embodiments, the light-emitting faces in the light sources can be oriented so that lines extending perpendicular to the light-emitting faces form an angle of about 35.25° with a plane in which the light-transmissive resin sheet extends locally.

The internal diagonal of each of the light sources (e.g., internal diagonal 150 of light source 120 as depicted in FIG. 1B) may, in some embodiments, form an angle with a plane in which the light-transmissive resin sheet extends locally of about 75° to about 90°, or about 80° to about 90°, or about 85° to about 90°. In some embodiments, the internal diagonal may form an angle of about 90° with a plane in which the light-transmissive resin sheet extends locally.

The light source may, in some embodiments, be oriented so that a first vertex of the light source is closest to a first surface in the light-transmissive resin sheet relative to other vertices in the light source. For example, as depicted in FIGS. 1A & 1B, vertex 122 in light source 120 is closest to first surface 160 of light-transmissive resin sheet relative to other vertices, such as vertex 126 and vertex 128. The first vertex may be at least about 0.1 mm or at least about 0.5 mm closer to the first surface relative to the second nearest vertex on the same light source. The light source may, in some embodiments, be oriented so that a second vertex of the light source is closest to a second surface in the light-transmissive resin sheet relative to other vertices in the light source. For example, as depicted in FIGS. 1A & 1B, vertex 124 in light source 120 is closest to second surface 165 of light-transmissive resin sheet relative to other vertices, such as vertex 132 and vertex 134. The second vertex may be at least about 0.1 mm or at least about 0.5 mm closer to the second surface relative to the second nearest vertex on the same light source. In some embodiments, the distance between the first surface and the first vertex is about the same as the distance between the second surface and the second vertex on the same light source. In some embodiments, each of the first of vertices on the light sources is about the same distance from the first surface of the light-transmissive resin sheet. In some embodiments, each of the second of vertices on the light sources is about the same distance from the second surface of the light-transmissive resin sheet.

The number of light sources disposed in the light-transmissive resin sheet is not particularly limited. The number of light sources disposed in the light-transmissive resin sheet can be, for example, at least about 1; at least about 2; at least about 8; at least about 16; at least about 32; at least about 64; at least about 128; or at least about 500. The number of light sources disposed in the light-transmissive resin sheet can be, for example, less than or equal to about 10,000; less than or equal to about 1000; less than or equal to about 500; less than or equal to about 128; less than or equal to about 64; or less than or equal to about 32. In some embodiments, the number of light sources disposed in the light-transmissive resin sheet is about 1 to about 10,000 or more; there is no limit to the number. The area density of the light sources is also not limited. In general, the greater the number of light sources per unit of area, the greater will be the number of lumens emitted by each unit area of the transmissive resin sheet.

The size of the light sources is not particularly limited. The light sources can have a largest dimension of, for example, at least about 0.1 mm; at least about 0.5 mm; at least about 1 mm; at least about 2 mm; at least about 5 mm; or at least about 1 cm. The light sources can have a largest dimension of, for example, less than or equal to about 10 cm; less than or equal to about 5 cm; less than or equal to about 1 cm; less than or equal to about 5 mm; or less than or equal to about 3 mm. In some embodiments, the light sources have a largest dimension of about 0.1 mm to about 10 cm. As an example, the light source can be a cubic-shaped light emitting diode having sides of about 1 mm and a largest dimension (or internal diagonal) of about 1.7 mm.

In some embodiments, the thickness of the light-transmissive resin sheet is greater than or equal to the largest dimension of the light sources. The thickness of the light-transmissive resin sheet (e.g., the distance between first surface 160 and second surface 165 in light-transmissive resin sheet 110 depicted in FIG. 1B) relative to the largest dimension of the light sources (e.g., the length of internal diagonal 150 of light source 120 depicted in FIG. 1B) can be, for example, at least about 1.5:1; at least about 2:1; or at least about 2.5:1. The thickness of the light-transmissive resin relative to the largest dimension of the light sources can be, for example, less than or equal to about 3:1; less than or equal to about 2.5:1; or less than or equal to about 2:1. In some embodiments, the thickness of the light-transmissive resin relative to the largest dimension of the light sources is about 1.5:1 to about 3:1.

The light sources may be randomly positioned in the light-transmissive resin sheet or may have a regular array (e.g., rectangular, square, hexagonal, rhombic, or oblique two-dimensional lattices). The light sources may be spaced apart a distance of, for example, at least about 0.1 mm; at least about 1 mm; at least about 5 mm; at least about 1 cm; at least about 2 cm; at least about 5 cm; or at least about 10 cm. The light sources may be spaced apart a distance of, for example, less than or equal to about 50 cm; less than or equal to about 25 cm; less than or equal to about 10 cm; less than or equal to about 5 cm; less than or equal to about 2 cm; or less than or equal to about 1 cm. In some embodiments, the light sources are spaced apart a distance of about 0.1 mm to about 50 CM.

In some embodiments, the light sources can have different orientations about an internal diagonal of the light sources. For example, the light sources may be randomly oriented about their internal diagonal relative to each other. As another example, the light sources may be oriented at fixed increments relative to each other (e.g., increments of 30°, 45°, 60°, 90°, 120°, etc.).

The lighting device can optionally include a reflective material to direct light to a desired region. For example, an aluminum coating may be applied to form the reflective layer. In some embodiments, a reflective material can be disposed on one or more edges (e.g., one, two, three, or four edges) of the light-transmissive resin sheet. The reflective material may prevent or reduce light emitted from the edges and increase light emitted from the top and/or bottom surfaces of the lighting device. In some embodiments, a reflective material can be disposed on one surface of the light-transmissive resin sheet. As an example, a reflective layer can be applied to first surface 160 of light-transmissive resin sheet 110 so that light is reflected and emitted from second surface 165 of light-transmissive resin sheet 110. As such, the reflective material may increase light intensity in a desired direction.

Figure 2:
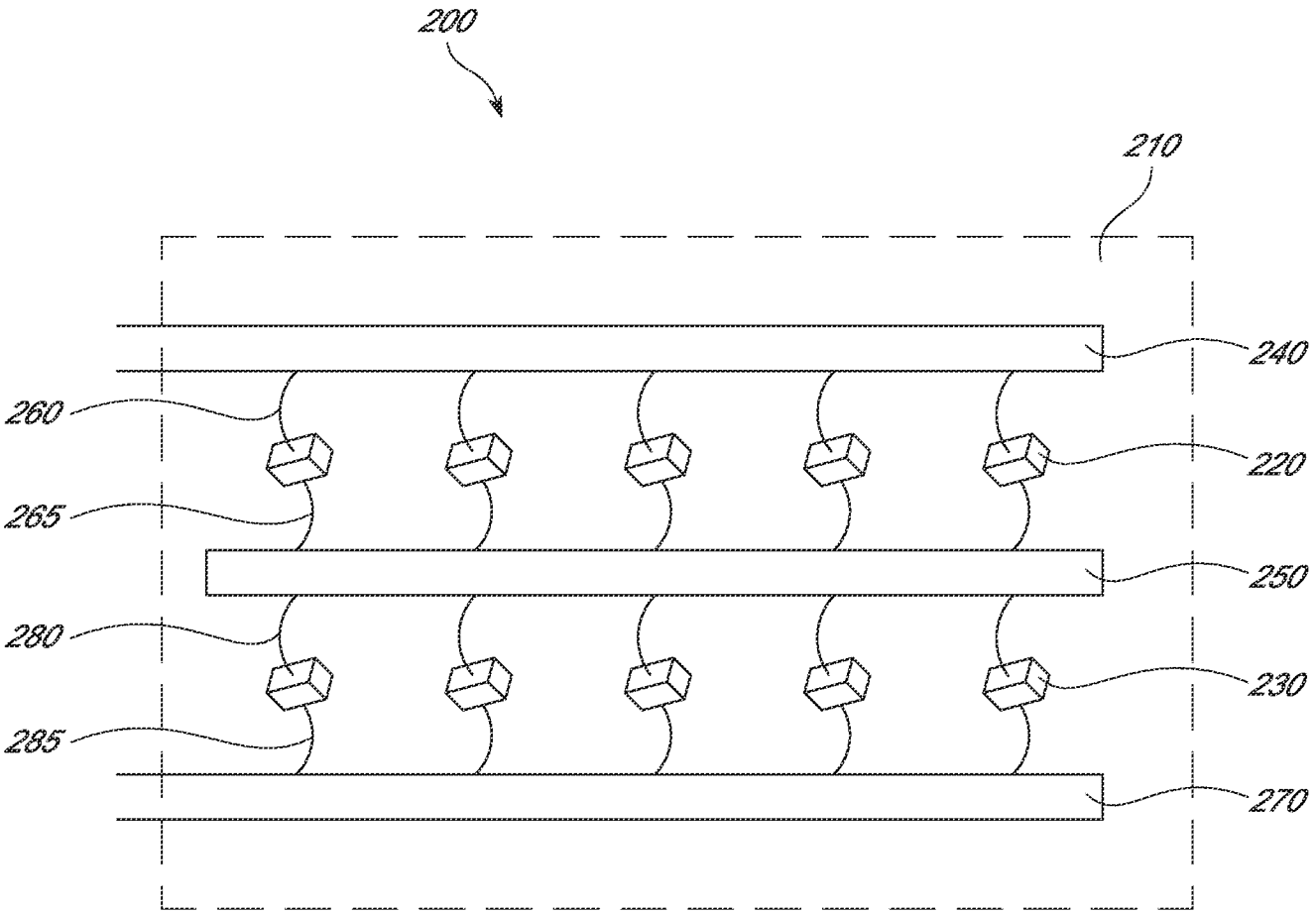
FIG. 2 is a top view of one example of a lighting device having a plurality of light sources that are electrically coupled.

FIG. 2 is a top view of one example of a lighting device having a plurality of light sources that are electrically coupled. Lighting device 200 includes light-transmissive resin sheet 210, first row of light sources 220, and second row of light sources 230. Each of the light sources in first row of light sources 220 are electrically coupled in parallel to bus 240 and conductive band 250 via wires, such as wire 260 and wire 265. Each of the light sources in second row of light sources 230 are electrically coupled in parallel to conductive band 250 and bus 270 via wires, such as wire 280 and wire 285. When an appropriate voltage is applied between bus 240 and bus 270, both first row of light sources 220 and second row of light sources 230 can emit light. Bus 240, bus 270, and conductive band 250 may each be disposed inside light-transmissive resin sheet or one side of light-transmissive resin sheet (e.g., disposed on first surface 160 of light-transmissive resin sheet 110 depicted in FIG. 1B). Bus 240 and bus 270 may be electrically coupled to an electrical connector (e.g., a NEMA connector). The skilled artisan, guided by the teachings in the present application, will appreciate that numerous other configurations for powering the light sources may be used, and therefore the present application is not limited to the configuration depicted in FIG. 2.

Figure 3:
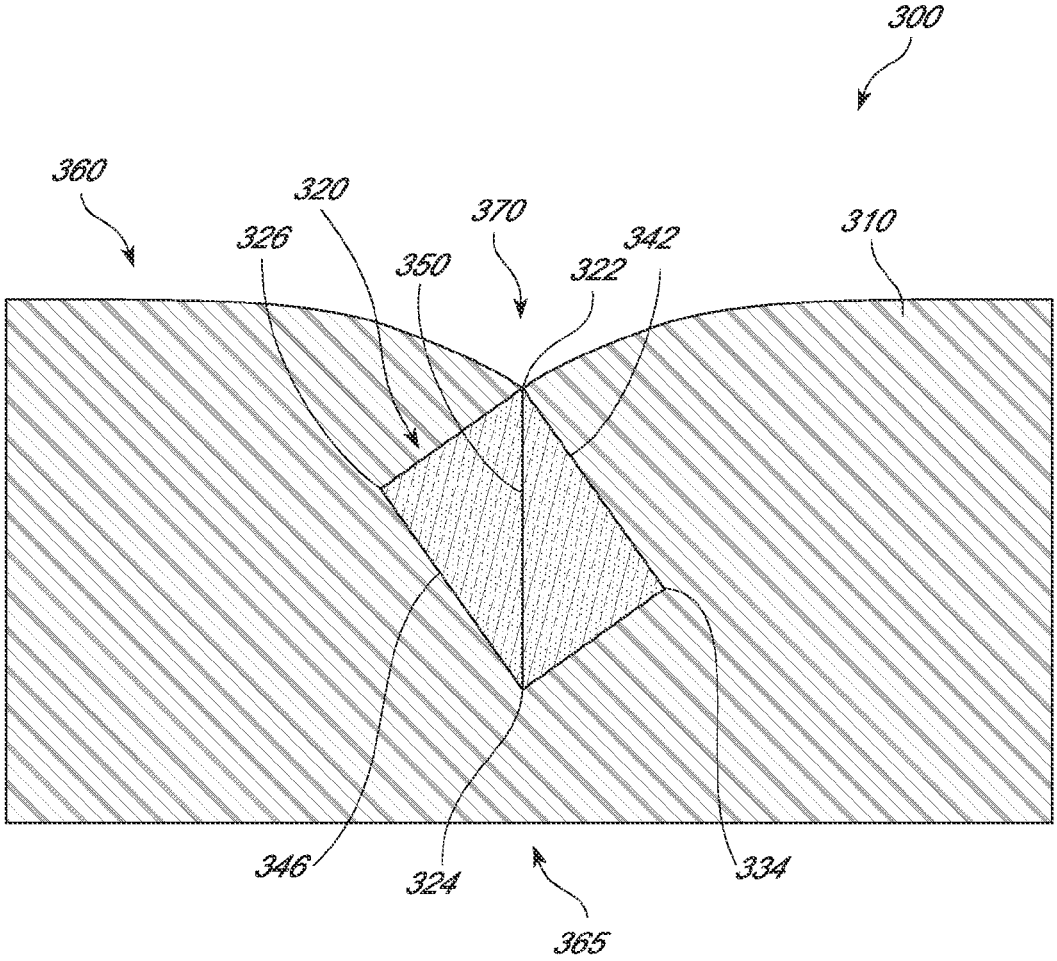
FIG. 3 is a cross-sectional view of a lighting device includes an indent disposed near a light source.

FIG. 3 is a cross-sectional view of a lighting device that includes an indent disposed near a light source. Lighting device 300 includes light-transmissive resin sheet 310 and light source 320. Light source 320 has generally the same configuration as light source 120 depicted in FIGS. 1A and 1B. Consequently, vertex 322, vertex 324, vertex 326, vertex 334, face 342, face 346, internal diagonal 350, first surface 360, and second surface 365 in FIG. 3 correspond to vertex 122, vertex 124, vertex 126, vertex 134, face 142, face 146, internal diagonal 150, first surface 160, and second surface 165 in FIGS. 1A and 1B, respectively. First surface 360 of light-transmissive resin sheet 310 includes indent 370 laterally aligned with internal diagonal 350 of light source 320. Without being bound to any particular theory, it is believed that the indent can increase an amount of light emitted from the light source that exhibits total internal reflection within the light-transmissive resin sheet, by changing the angle at which the most upwardly-directed rays leaving the light source 320 first encounter the resin/glass interface. In some embodiments, the light-transmissive resin sheet can include indents on both sides. For example, a second indent can be on second surface 365 that is laterally aligned with internal diagonal 350 (not shown).

The number of indents in the light-transmissive resin sheet may vary, for example, according to the number of light sources. The number of indents in the light transmissive resin sheet relative to a number of light sources in the light-transmissive resin sheet may be, for example, at least about 50%; at least about 80%; at least about 100%; or at least about 150%. The number of indents in the light transmissive resin sheet relative to a number of light sources in the light-transmissive resin sheet may be, for example, less than or equal to about 200%; less than or equal to about 150%; or less than or equal to about 100%. In some embodiments, the number of indents in the light transmissive resin sheet relative to a number of light sources in the light-transmissive resin sheet is of about 50% to about 200%. In some embodiments, the number of indents in the light transmissive resin sheet is about the same as the number of light sources in the light-transmissive resin sheet. As an example, a lighting device can include 16 light sources and 16 indents, each laterally aligned with a different light source on the same side of the light-transmissive resin sheet. In some embodiments, the number of indents in the light transmissive resin sheet is about twice the number of light sources in the light-transmissive resin sheet. As an example, a lighting device can include 16 light sources and 32 indents. 16 of the indents are on one side of the light-transmissive resin sheet and laterally aligned with a different light source. 16 of the indents are on an opposite side of the light-transmissive resin sheet and laterally aligned with a different light source.

Figure 4:
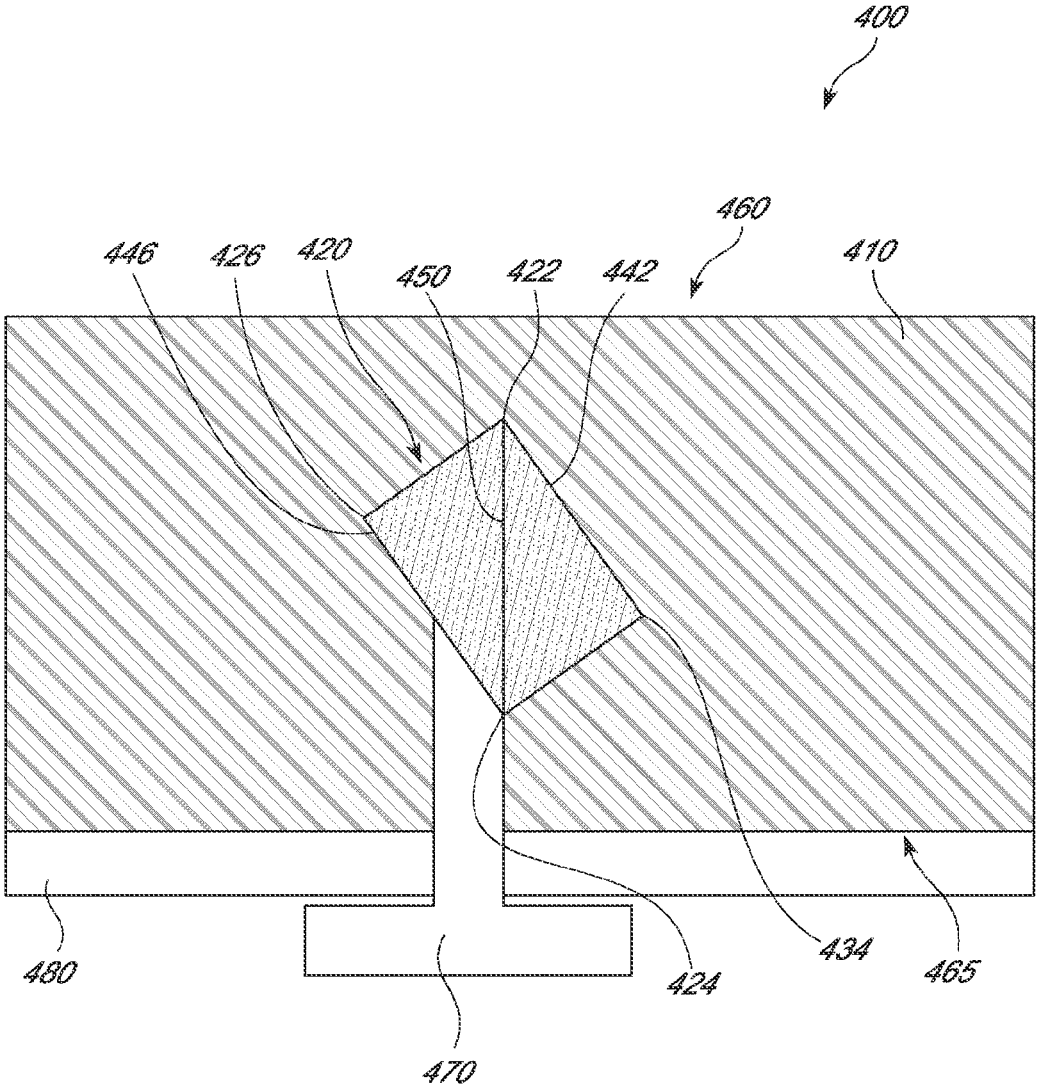
FIG. 4 is a cross-sectional view of one example of a lighting device having a heat-dissipation configuration that is within the scope of the present application.

FIG. 4 is a cross-sectional view of one example of a light device having a heat-dissipation configuration that is within the scope of the present application. Lighting device 400 includes light-transmissive resin sheet 410 and light source 420. Light source 420 has generally the same configuration as light source 120 depicted in FIGS. 1A and 1B. Consequently, vertex 422, vertex 424, vertex 426, vertex 434, face 442, face 446, internal diagonal 450, first surface 460, and second surface 465 in FIG. 4 correspond to vertex 122, vertex 124, vertex 126, vertex 134, face 142, face 146, internal diagonal 150, first surface 160, and second surface 165 in FIGS. 1A and 1B, respectively. Heat sink 470 extends from second surface 465 of light-transmissive resin sheet 410 to face 446 of light source 420 to thermally couple light source 420 with the exterior of lighting device 400. Reflective layer 480 is optionally disposed on second surface 465 so the light can be reflected to towards first surface 460. Thus, lighting device 400 is configured to emit light from first surface 460. A portion or all of the light sources in the lighting device can optionally be thermally coupled to a heat sink. For example, a lighting device having 10 light sources may also include 10 heat sinks, each thermally coupled to a different light source. Alternatively, one heat sink (for example, a metal plate or sheet) can be thermally coupled to various or plural light sources via respective heat sinks 470. Reflective layer 480 may optionally act as such a single heat sink. The heat sinks 470 may also act as electrodes to make contact with respective light sources 420, for example on a face hidden from view in FIG. 4, with another electrode (not shown) to complete a circuit. In this case heat sink 470, and optionally the reflective layer 480, both conduct heat and electricity. Each heat sink 470 can be in close thermal contact with light source 420.

The lighting device can be configured to obtain a desired level of light output by modifying, for example, the number of light sources. The lighting device may, for example, have a light output of, for example, at least about 100 lumens; at least about 500 lumens; at least about 1000 lumens; at least about 2000 lumens; or at least about 5000 lumens or more.

The lighting device can be configured to emit various colors, such as visible light, ultraviolet or infrared light, red, green, blue, yellow, or white light. In some embodiments, the lighting device emits white light. The light device may, in some embodiments, contain light sources that emit white light. In some embodiments, the lighting device includes light sources that emit different colors of light that, when combined, provide white light, or light sources which illuminate fluorescent materials or nanoparticles to cause them to emit light of certain or various colors. For example, the lighting device may contain different light sources that emit one of the colors red, green, or blue. The different light sources may together provide white light.

Some embodiments disclosed herein include a method for making a lighting device. The methods can be used, in some embodiments, to prepare any of the light devices disclosed in the present application. As an example, the methods can be used to prepare lighting device 200 depicted in FIG. 2.

Figure 5:
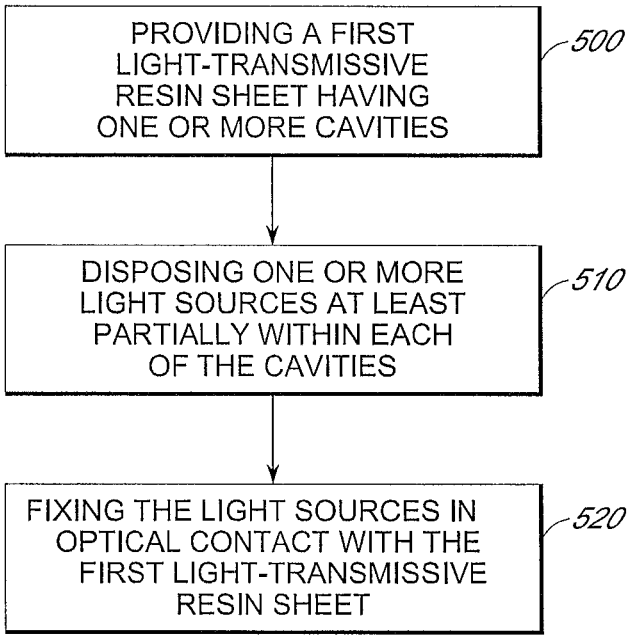
FIG. 5 is a flow diagram showing one example of a process for making a lighting device.

FIG. 5 is a flow diagram showing one example of a process for making a lighting device. The process includes "Providing a first light-transmissive resin sheet having one or more cavities," as illustrated in block 500; "Disposing one or more light sources at least partially within each of the cavities," as illustrated in block 510; and "Fixing the light sources in optical contact with the first light-transmissive resin sheet," as illustrated in block 520.

Figure 6A:
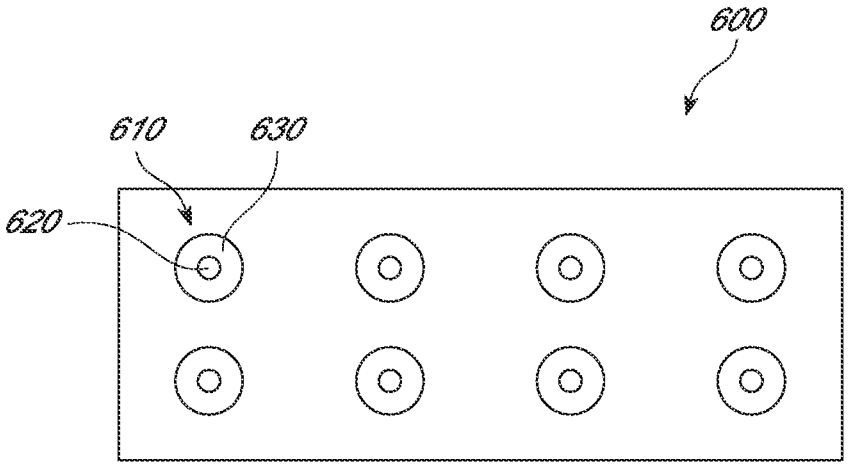
FIG. 6A shows a top view of one example of a light-transmissive resin sheet for use in the process for making the lighting device.

At operation 500 depicted in FIG. 5, a light-transmissive resin sheet is provided with cavities for receiving light sources. FIG. 6A shows a top view of one example of a light-transmissive resin sheet for use in the process for making the lighting device. Light-transmissive resin sheet 600 includes a plurality of cavities 610. Each cavity includes a cylindrical hole 620 and counterbore 630. Cavities 610 can be dimensioned so that only one vertex of a light source can be inserted into cylindrical hole 620. Cavities 610 may have the same or different dimensions. The light-transmissive resin sheet can have generally the same characteristics as those disclosed with regard to the light device. The cavities may be formed, for example, using standard drilling, imprinting, or molding procedures.

Figure 6B:
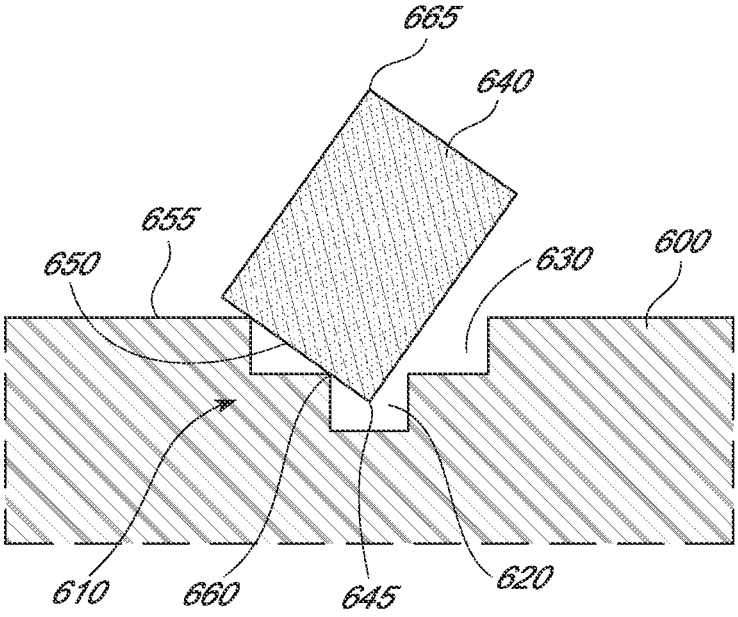
FIG. 6B shows a partial, cross-sectional view of a cubic light source disposed in the cavity of the light-transmissive resin sheet.

Returning to FIG. 5, at operation 510 light sources can be disposed in the cavities of the light-transmissive resin sheet. In some embodiments, the light sources are disposed in the light-transmissive resin sheet so that the light sources have a desired orientation relative to the light-transmissive resin sheet. For example, the light sources may be disposed in the light transmissive resin sheet so that the internal diagonal of the light source may form an angle of about 90° with a plane in which the light-transmissive resin sheet extends locally. FIG. 6B shows a partial, cross-sectional view of a cubic light source disposed in the cavity of the light-transmissive resin sheet. Light source 640 is disposed in cavity 610 so that vertex 645 is located within cylindrical hole 620. Edge 650 contacts corner 655 and corner 660 formed by cylindrical hole 620 and counterbore 630. Two additional edges of cubic light source 640 may also contact corner 655 and corner 660 formed by cylindrical hole 620 and counterbore 630 (not shown in the cross section; when viewed from above the sheet 600, three edges spaced 120 degrees apart from one another can make contact simultaneously). Various other shapes for the cavity may be used, including but not limited to a cylindrical hole or countersink-shape. Another example is a cavity shape into which one apex of light source 640 will fit snugly, such that the light source 640 will be held in the correct orientation, for example with the line between two opposed vertices being substantially perpendicular to the surface of the resin sheet. This shape might be formed in the resin sheet by impressing a hot metal die into the surface of the resin sheet, and/or by first locally heating the area to be impressed by the die to form the impressed cavity shape.

Figure 6C:
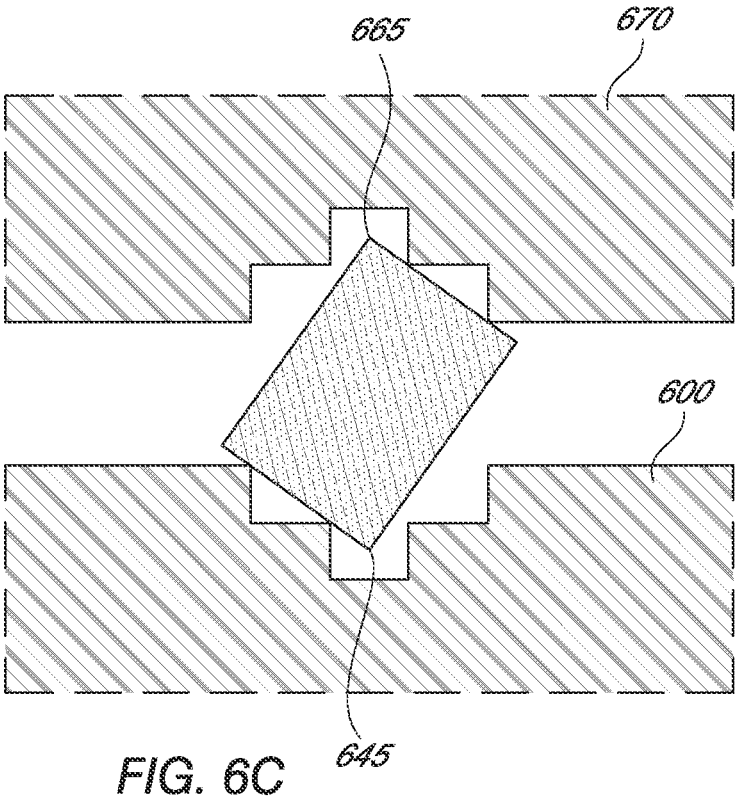
FIG. 6C shows a partial, cross-sectional view of a cubic light source disposed in a cavity between two light-transmissive resin sheets.

A second light-transmissive resin sheet can optionally be disposed on an opposite side of the light sources. The second light-transmissive resin sheet may have the same configuration of cavities so that only one vertex from each light source can be disposed in different cavities from the second light-transmissive resin sheet. As an example, second light-transmissive resin sheet 670 can be placed over light source 640 as depicted in FIG. 6C so that vertex 665 is disposed in cavity 680. In some embodiments, scattering elements, such as silica particles can be disposed between the two light-transmissive resin sheets or fixed within one or both of the light-transmissive resin sheets.

In some embodiments, a heat sink may optionally be disposed in contact with the light source. For example, the light-transmissive resin sheet may include a cylindrical hole extending through the entire thickness of the light-transmissive resin sheet. An appropriate heat sink can be placed through the hole in thermal contact with the light source.

The light sources can be electrically coupled to an electrical connector before or after being disposed in the light-transmissive resin sheet. For example, the light sources can be electrically coupled to a bus as depicted in FIG. 2. The can be completed using standard soldering procedures.

Referring again to FIG. 5, at operation 530, the light sources are fixed in optical contact with one or more light-transmissive resin sheets. Generally, the light sources may be fixed in optical contact by applying heat and optionally pressure. The heat can melt or soften the resin so that it becomes in optical contact with the light sources. Optical contact between the resin and the outside of the light sources may guide rays leaving the surface of the light source in such a way that they are internally reflected at the resin/air interface. In some embodiments, every portion of the surface of the light source from which rays pass into the resin is in optical contact with the resin. Here, "optical contact" means that the passage of rays between the light source and the resin is in accordance with the laws of optics as determined by their respective indices of refraction. In some embodiments, the heat may also weld together two light-transmissive resin sheets. The heat may be applied using, for example, friction, radiation (e.g., microwave, RF, infrared, and the like), or ultrasonic heating. After applying suitable heat and pressure, the light sources can be fixed within the light-transmissive resin (e.g., as light source 120 is fixed within light-transmissive resin sheet 110 as depicted in FIGS. 1A & 1B). The heat can be applied to one or both sides of the light source, and may be applied to both sides at different times. The heat can also be applied locally to reduce damage to the light sources. The skilled artisan, guided by the teachings of the present application, will appreciate that an indent (e.g., indent 370 of lighting device 300 depicted in FIG. 3) can be formed by modifying processing characteristics, such as the heating time, heating temperature, and dimensions of the cavity. The skilled artisan will also be able to adjust the parameters of the process to optimize the shape of an indent, such as the indent 370 illustrated in FIG. 3, which can result from the above-described processes. The shape of an indent 370 resulting from such processes might be adjusted by adjusting the particular shapes and dimensions of the cavities, and/or process parameters such as the local temperature of the resin, and the temperature as a function of time. The shape indent 370 itself can be optimized to internally reflect the highest proportion of the rays leaving the light source 120.

The process for making the light device may be completed using continuous production. For example, an extended roll of a light-transmissive resin sheet can be continuously passed through stations for forming the cavities, disposing the light sources, electrically coupling the lights sources, and fixing the light sources.

Some embodiments disclosed herein include a method of producing light. The method can include applying a voltage to one or more light sources in a lighting device. The lighting device can be any of the lighting devices disclosed in the present application. As an example, the method can include applying a voltage between bus 240 and bus 270 in lighting device 200 as depicted in FIG. 2 to produce light.

With respect to the use of substantially any plural and/or singular terms herein, those having skill in the art can translate from the plural to the singular and/or from the singular to volume of wastewater can be received in the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible sub-ranges and combinations of sub-ranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 articles refers to groups having 1, 2, or 3 articles. Similarly, a group having 1-5 articles refers to groups having 1, 2, 3, 4, or 5 articles, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

EXAMPLES

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

Example 1

Preparing a Lighting Device

Two transparent polycarbonate sheets having a thickness of about 2 mm, length of about 15 cm, and height of about 15 cm are machined to produces cavities having about the same dimensions. A 4 by 4 grid of 16 cylindrical holes are drilled into the polycarbonate sheets, each of the holes are about 4 cm apart. The cylindrical holes have a depth of about 0.8 mm and a diameter of about 0.9 mm. Cubic light emitting diodes having a side of about 1 mm are pre-soldered to two short wires. The light emitting diodes are then disposed in each of the cavities of one of the polycarbonate sheets so that one vertex is inserted into each cavity. Buses are disposed adjacent to the light emitting diodes and aligned with the grid network of cavities. The two wires on each light emitting diode are soldered to different buses configured to have opposite polarity. The second polycarbonate sheet is placed over the light emitting diodes so that the cavities align with the light emitting diodes. The polycarbonate sheets are friction welded together at each of the light emitting diodes to form the lighting device. The lighting device is spirally wound into a roll for shipment.

Example 2

Lighting Device for Kitchen Lighting

Several lighting devices prepared according to Example 1 are each laminated to a reflective aluminum film on one side. The lighting devices are then fixed underneath kitchen cabinets using an adhesive so that the aluminum film is positioned between the light sources and the kitchen cabinets. The lighting devices are connected to a power supply and illuminate counters below the kitchen cabinets. It is expected that the light devices exhibit a uniform light distribution so that the location of individual light sources in the lighting device are not readily detectable.

Example 3

Maximal Angle of Rays for Light Sources

When an LED is oriented so that a line passing through its internal diagonal is perpendicular to the surface of the light-transmissive resin sheet in which it is embedded, then the edges radiating from the uppermost corner will be seen from above as three lines deployed at 120° to each other. Let the cube edges be one unit long. Since the three edges are all at 90° relative to one another, the right triangle formed by any two edges and a line through the center point of the side between those edges has sides in ratio 1:1:1.414. Now divide that triangle in half by a line lying in the cube side and bisecting the angle between the two edges, thus resulting in two congruent mirror-image right triangles. These two triangles will each have two sides measuring 1 and 0.707, so that by the Pythagorean theorem the third side will also measure 0.707.

Next, project the three edges onto the plane in which lie the three end points of the edges and also the center points of the cube's sides. By symmetry, the apex of the cube projects to the center point of an equilateral triangle having sides of length 1.414. The distance of the projected center point from any side can be obtained from a right triangle formed by one corner, the projected center point, and a midpoint of an edge, in which the base (from the end of the edge to the projected midpoint) measures 0.707, by the paragraph above, and the tangent of the included angle, 30 degrees, gives the length of the other leg as 0.707 tan 30=0.408.

Returning to 3-space, this 0.408 is also the base of a new, upright right triangle which lies inside the pyramid-like solid defined by the apex and the ends of the three cube edges. The hypotenuse of the triangle, extending from the apex to the midpoint of the cube's side, measures 0.707; its base measures 0.408, by the paragraph above. Thus the angle between the side of the cubical die and the line passing through two opposing corners of the cube is arcsine (0.408/0.707) or 35.25°. For a cubical LED die embedded in a planar sheet in the cocked position, a ray of light exiting the die face at a normal angle will make this angle with the resin/air interface, so the angle of incidence (which is the angle between the ray and a normal to the interface) is the complementary angle of 54.75°. This ray will be totally internally reflected, because the critical angle is arcsine ($n_{air}/n_{resin}$) or approximately arcsine 0.66=42°, and 54.75° exceeds it.

Example 4

Including Dimples

Light rays exiting from an LED into resin lie within a cone with an angle of 27° between the center line and the side, due to the index of refraction of LED semiconductor material being much higher than that of resin, which causes rays at larger angles to internally reflect within the LED. Therefore, some rays leaving the LED will hit the resin/air interface at 54.75°−27°=27.75°, which is less than the critical angle by about 14 degrees. Therefore some of the rays leaving the die will not be internally reflected but instead will be refracted at the interface and escape, causing bright spots around the LEDs at certain angles, and possibly making the illumination non-uniform.

The concave indent can increase the angle at which rays in the light cone from the die encounter the resin/air interface. If the upper edge of the light-ray cone hits not the planar interface but a portion which is tilted by 14° (according to the calculation in Example 3), then the rays at the upper edge of the cone will be internally reflected and so will all the others. Moreover, the internally-reflected rays will be turned toward the plane of the sheet by 28° and therefore will be trapped inside, as desired.

An LED die can be quite small, e.g., about a millimeter across or less, and in a typical LED package the die can barely be seen, in spite of the magnifying-lens effect of the rounded package tip. Therefore, the dimple can be quite small. If the upper corner of the die is close to the plane of the sheet, then its more-upwardly-inclined rays will intersect the plane of the sheet surface within a circle that is approximately as large as the LED itself. Also, the dimple need not be deep, because the surface tilt of only about 15° may ensure total internal reflection.

What is claimed is:

1. A lighting device comprising:

a light-transmitting resin sheet extending locally in a first plane; and one or more light sources disposed within the light-transmissive resin sheet, each of the light sources comprising one or more light-emitting faces each extending in different planes, wherein each of the different planes of the light-emitting faces form an angle with the first plane of the light-transmitting resin sheet of about 35° to about 75°.

2. The lighting device of claim 1, wherein the light sources are light emitting diodes.

3. The lighting device of claim 1, wherein the light sources have a cuboidal shape.

4. The lighting device of claim 3, wherein each of the light sources comprises an internal diagonal extending between opposite vertices of the light sources, and wherein the internal diagonal of each of the light sources forms an angle of about 75° to about 90° with the first plane of the light-transmissive resin sheet.

5. The lighting device of claim 4, wherein the internal diagonal of each of the light sources is approximately perpendicular to the first plane of the light-transmissive resin sheet.

6. The lighting device of claim 1, wherein the light sources are cubic-shaped.

7. The lighting device of claim 1, further comprising one or more electrical connectors electrically coupled to the light sources.

8. The lighting device of claim 7, further comprising a bus configured to electrically couple the light sources and the electrical connectors.

9. The lighting device of claim 1, further comprising a reflective material applied to one or more edges of the light-transmissive resin sheet.

10. The lighting device of claim 1, further comprising an at least partially reflective material applied to at least one side of the light-transmissive resin sheet.

11. The lighting device of claim 1, wherein the lighting device is rigid.

12. The lighting device of claim 1, wherein the lighting device is flexible.

13. The lighting device of claim 1, wherein a first number of the light sources are configured to emit a first color and a second number of the light sources are configured to emit a second color, and wherein the first color is different from the second color.

14. The lighting device of claim 1, wherein the lighting device is configured to emit white light.

15. The lighting device of claim 1, wherein the light-transmissive resin sheet comprises one or more indents on one side of the light-transmissive resin sheet, each of the indents are laterally aligned in the first plane with one of the light sources.

16. The lighting device of claim 1, wherein the light sources form a regular array within the light-transmissive resin sheet.

17. The lighting device of claim 1, wherein the light sources have different orientations about an internal diagonal of the light sources.

18. The lighting device of claim 1, wherein the angle between each of the different planes of the light-emitting faces and the first plane of the light-transmissive resin sheet is about 50° to about 60°.

19. The lighting device of claim 1, wherein the light-transmissive resin sheet comprises at least one of a polycarbonate, an acrylic, an epoxy, polyolefins, polyesters, and copolymers thereof.

20. The lighting device of claim 1, further comprising one or more scattering elements disposed within the light-transmissive resin sheet.

21. The lighting device of claim 1, further comprising one or more heat sinks disposed on one side of the light-transmissive resin sheet, wherein the one or more heat sinks are thermally coupled to the light sources.

22. The lighting device of claim 1, wherein the light-transmissive resin sheet comprises one or more recesses on one side of the light-transmissive resin sheet, each of the recesses disposed near one of the light sources.

23. A lighting device comprising:

a light-transmitting resin sheet extending locally in a first plane; and one or more light sources disposed within the light-transmitting resin, each of the light sources comprising two or more light-emitting faces extending in different planes that meet at a vertex, wherein each of the different planes of the light-emitting faces form about the same angle with the first plane of the light-transmitting resin sheet.

24. A method for making a lighting device, the method comprising:

providing a first light-transmitting resin sheet comprising one or more cavities on one side of the first light-transmitting resin sheet, wherein the first light-transmitting resin sheet extends in a first plane;

disposing one or more light sources at least partially within each of the cavities of the first light-transmitting resin sheet, wherein the light sources each comprise one or more light-emitting faces extending in different planes, and wherein each of the different planes of the light-emitting faces form an angle with the first plane of the first light-transmitting resin sheet of about 35° to about 75°; and fixing the light sources in optical contact with the first light-transmitting resin sheet.

25. A method of producing light, the method comprising applying a voltage to one or more light sources effective for the light sources to emit light from one or more light-emitting faces on each of the light sources, wherein the light sources are disposed within a light-transmitting resin sheet extending in a first plane, and the light-emitting faces on each of the light sources extend in different planes that form an angle with the first plane of the light-transmitting resin sheet of about 35° to about 75°.

* * * * *